US008847868B2

(12) United States Patent
Moon et al.

(10) Patent No.: US 8,847,868 B2
(45) Date of Patent: Sep. 30, 2014

(54) LIQUID CRYSTAL DISPLAY AND FRAME RATE CONTROL METHOD THEREOF

(71) Applicant: LG Display Co., Ltd., Seoul (KR)

(72) Inventors: Myungkook Moon, Goyang-si (KR); Jongwoo Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 189 days.

(21) Appl. No.: 13/692,714

(22) Filed: Dec. 3, 2012

(65) Prior Publication Data

US 2013/0278585 A1 Oct. 24, 2013

(30) Foreign Application Priority Data

Apr. 24, 2012 (KR) ..... 10-2012-0042658

(51) Int. Cl.
*G09G 3/36* (2006.01)
*G09G 3/20* (2006.01)

(52) U.S. Cl.
CPC ..... *G09G 3/36* (2013.01); *G09G 3/3614* (2013.01); *G09G 2340/0435* (2013.01); *G09G 3/2077* (2013.01); *G09G 3/3648* (2013.01)
USPC ..... 345/96; 345/209; 345/690; 345/89

(58) Field of Classification Search
CPC ..... G09G 3/2051–3/2005; G09G 3/3614; G09G 3/2077; G09G 3/2803
USPC ..... 345/96, 209, 690, 89
See application file for complete search history.

(56) References Cited

U.S. PATENT DOCUMENTS

| | | | | |
|---|---|---|---|---|
| 7,948,465 | B2 | 5/2011 | Cho et al. | |
| 2008/0284704 | A1 * | 11/2008 | Song et al. | 345/94 |
| 2009/0122054 | A1 * | 5/2009 | Lee et al. | 345/214 |
| 2009/0179845 | A1 * | 7/2009 | Song et al. | 345/90 |
| 2010/0148829 | A1 | 6/2010 | Hong et al. | |
| 2010/0149082 | A1 | 6/2010 | Hong et al. | |
| 2010/0156885 | A1 | 6/2010 | Cho et al. | |
| 2010/0231564 | A1 * | 9/2010 | Min et al. | 345/209 |
| 2011/0007098 | A1 * | 1/2011 | Park et al. | 345/690 |

FOREIGN PATENT DOCUMENTS

| | | | |
|---|---|---|---|
| JP | 2006-163088 | A | 6/2006 |
| KR | 10-2007-0112034 | A | 11/2007 |
| KR | 10-2010-0068936 | A | 6/2010 |
| KR | 10-2010-0068938 | A | 6/2010 |
| KR | 10-2010-0073718 | A | 7/2010 |
| KR | 10-2011-0062766 | A | 6/2011 |

* cited by examiner

*Primary Examiner* — Long D Pham
(74) *Attorney, Agent, or Firm* — Birch, Stewart, Kolasch & Birch, LLP

(57) ABSTRACT

A liquid crystal display includes a frame rate control (FRC) device which adds an FRC compensation value to digital video data using a plurality of FRC patterns defining subpixels, to which the FRC compensation value will be written, and a data driving circuit which converts the digital video data received from the FRC device into a data voltage and invert a polarity of the data voltage based on a previously determined inversion method. The FRC device counts frame periods and increases a frame count value each time the frame period changes. The FRC device changes to a next FRC pattern in previously determined order in response to the frame count value, and holds or skips the frame count value when the frame period reaches a previously determined time.

7 Claims, 10 Drawing Sheets

LIQUID CRYSTAL DISPLAY AND FRAME RATE CONTROL METHOD THEREOF

This application claims the benefit of Korean Patent Application No. 10-2012-0042658 filed on Apr. 24, 2012, the entire contents of which is incorporated herein by reference for all purposes as if fully set forth herein.

BACKGROUND OF THE INVENTION

1. Field of the Invention

Embodiments of the invention relate to a liquid crystal display and a frame rate control method thereof.

2. Discussion of the Related Art

As shown in FIG. 1, an active matrix liquid crystal display reproduces an input image on pixels each including a thin film transistor (TFT) as a switching element. The TFT supplies a data voltage Vdata supplied through a data line to a pixel electrode of a liquid crystal cell Clc in response to a gate pulse (or a scan pulse) supplied through a gate line. Each of the pixels of the active matrix liquid crystal display includes red (R), green (G), and blue (B) subpixels for color representation, and each of the red (R), green (G), and blue (B) subpixels includes the liquid crystal cell Clc, the TFT, a storage capacitor Cst, etc. The liquid crystal cell Clc includes the pixel electrode to which the data voltage Vdata is supplied, a common electrode to which a common voltage Vcom is supplied, and a liquid crystal layer formed between the pixel electrode and the common electrode. Liquid crystal molecules of the liquid crystal layer move based on an electric field applied between the pixel electrode and the common electrode and adjust an amount of light passing through a polarizing plate attached to an upper plate of a liquid crystal display panel.

In FIGS. 1 and 2, "Vdata" is a positive and negative data voltage output from a source driver integrated circuit (IC), and "Vgate" is a gate high or low voltage output from a gate driver IC. The gate pulse is generated at the gate high voltage, which is set to be equal to or greater than a threshold voltage of the TFT, and turns on the TFT. "Cst" is a storage capacitor for holding a voltage of the liquid crystal cell Clc, and "Cgs" is a parasitic capacitance between a gate electrode and a source electrode of the TFT. "Vp(+)" is the positive data voltage charged to the liquid crystal cell Clc, and "Vp(−)" is the negative data voltage charged to the liquid crystal cell Clc.

As shown in FIG. 2, the active matrix liquid crystal display periodically inverts a polarity of the data voltage, so as to reduce degradation of liquid crystals and image sticking. A frame inversion method, a column inversion method, a line inversion method, a dot inversion method, etc. are known as a method for driving the active matrix liquid crystal display.

As shown in FIGS. 1 and 2, the positive data voltage is supplied to the liquid crystal cell Clc for a scan time of an n-th frame period Fn (where n is a positive integer), and then the negative data voltage is supplied to the liquid crystal cell Clc for a scan time of an (n+1)-th frame period (Fn+1). For the scan time of the n-th frame period Fn, the liquid crystal cell Clc is charged to the positive data voltage and is held at the positive voltage Vp(+), which is reduced by ΔVp because of the parasitic capacitance Cgs of the TFT. For the scan time of the (n+1)-th frame period (Fn+1), the liquid crystal cell Clc is charged to the negative data voltage and is held at the negative voltage Vp(−), which is reduced by ΔVp because of the parasitic capacitance Cgs of the TFT. Thus, even if the positive data voltage and the negative data voltage, which are set at the same gray level, are supplied to the liquid crystal cell Clc, a luminance of the liquid crystal cell Clc may change depending on the polarity of the data voltage. If one frame period has a short duration or the liquid crystal cell Clc is held at the data voltage of the same polarity for a short period of time, a user may not recognize a luminance difference. On the other hand, if the duration of one frame period increases or a hold time of the liquid crystal cell Clc at the data voltage of the same polarity increases, the user may recognize the luminance difference.

ΔVp changes depending on the parasitic capacitance Cgs of the TFT as indicated by the following Equation (1).

$$\Delta Vp = \frac{Cgs}{Clc + Cst + Cgs} \times \Delta Vg \tag{1}$$

In the above Equation (1), ΔVg is a difference between the gate high voltage and the gate low voltage.

Most of the liquid crystal displays have recently used a frame rate control (FRC) method which reduces the number of bits of data and reduces the number of data transfer lines to thereby compensate for a reduction of image quality. The FRC method increases the number of representable gray levels using a compensation method illustrated in FIGS. 3 and 4 while reducing the number of bits of digital video data input to the source driver IC, thereby compensating for a loss of the image quality.

A principle of the frame rate control is described with reference to FIGS. 3 and 4.

FIG. 3 illustrates an example where a FRC compensation value is distributed in terms of time so as to finely adjust a luminance at a gray level less than 1-gray level. As shown in (a) of FIG. 3, if the FRC compensation value '1' is written to subpixels of a pixel array only during one frame period of four frame periods, a viewer may recognize a gray level of the subpixels at one-quarter gray level (i.e., the luminance of 25%) during the four frame periods. As shown in (b) of FIG. 3, if the FRC compensation value '1' is written to the subpixels of the pixel array only during two frame periods of the four frame periods, the viewer may recognize a gray level of the subpixels at one-half gray level (i.e., the luminance of 50%) during the four frame periods. As shown in (c) of FIG. 3, if the FRC compensation value '1' is written to the subpixels of the pixel array only during three frame periods of the four frame periods, the viewer may recognize a gray level of the subpixels at third-quarter gray level (i.e., the luminance of 75%) during the four frame periods.

FIG. 4 illustrates an example of a dithering method for spatially distributing a FRC compensation value so as to finely adjust a luminance at a gray level less than 1-gray level. The dithering method adjusts the number of subpixels, to which the FRC compensation value is written, in a dither mask of a predetermined size including a plurality of subpixels D1 to D4 and spatially distributes the FRC compensation value, so as to finely adjust the luminance at the gray level less than 1-gray level. As shown in (a) of FIG. 4, when a dither mask including, for example, 2×2 subpixels is used, if the FRC compensation value '1' is written to one subpixel D1 in the dither mask, the viewer may recognize a gray level of the dither mask at one-quarter gray level (i.e., the luminance of 25%). As shown in (b) of FIG. 4, if the FRC compensation value '1' is written to two subpixels D2 and D3 in the dither mask, the viewer may recognize a gray level of the dither mask at one-half gray level (i.e., the luminance of 50%). As shown in (c) of FIG. 4, if the FRC compensation value '1' is written to three subpixels D2, D3, and D4 in the dither mask, the viewer may recognize a gray level of the dither mask at three-quarter gray level (i.e., the luminance of 75%).

The FRC applied to the liquid crystal display generally uses both the time distribution method of FIG. 3 and the spatial distribution method of FIG. 4 to implement a method illustrated in FIG. 5. The FRC compensation value may be successively written to the same subpixels. In this instance, a luminance of the subpixels, to which the FRC compensation value is successively written, is greater than a luminance of other subpixels. Therefore, luminance uniformity of the liquid crystal display and color representation characteristic are reduced. For example, a specific color may be more remarkably represented than other colors. To solve the above problem, the FRC previously sets FRC patterns defining a position of the subpixels, to which the FRC compensation value will be written, to various forms, circulates the FRC patterns in each frame period, and changes the position of the subpixels, to which the FRC compensation value is written, in each frame period. For example, as shown in FIG. 5, a position of the subpixels, to which the FRC compensation value is written, in FRC patterns P1 and P3 used in odd-numbered frame periods N and N+2 alternates with a position of the subpixels, to which the FRC compensation value is written, in FRC patterns P2 and P4 used in even-numbered frame periods N+1 and N+3.

As described above, the polarity of the data voltage supplied to the pixel array of the liquid crystal display is inverted in terms of time and space based on a polarity inversion method. As shown in FIG. 5, the FRC compensation value may be written to subpixels, which are driven at the same polarity for a long period of time, in the pixel array driven based on the polarity inversion method. In this instance, the polarities of the subpixels, to which the FRC compensation value is written, are dominant to one polarity. For example, in FIG. 5, the FRC compensation value is written to subpixels charged to the positive data voltage. Thus, because the FRC compensation value is successively written to subpixels charged to the data voltage of the same polarity for a long period of time, the image sticking may appear due to the DC drive of the subpixels.

SUMMARY OF THE INVENTION

Embodiments of the invention provide a liquid crystal display and a frame rate control method thereof capable of reducing image sticking.

In one aspect, there is a liquid crystal display including a frame rate control (FRC) device configured to add an FRC compensation value to digital video data using a plurality of FRC patterns defining subpixels, to which the FRC compensation value will be written, a data driving circuit configured to convert the digital video data received from the FRC device into a data voltage and invert a polarity of the data voltage based on a previously determined inversion method, and a liquid crystal display panel including a pixel array charged to the data voltage received from the data driving circuit.

The FRC device counts frame periods and increases a frame count value each time the frame period changes. The FRC device changes to a next FRC pattern in previously determined order in response to the frame count value and holds or skips the frame count value when the frame period reaches a previously determined time.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

A frame rate control (FRC) method according to an example embodiment of the invention counts frame periods, increases a frame count value each time the frame period changes, and selects a next FRC pattern in previously determined order in response to the frame count value. In particular, the FRC method holds or skips the frame count value when the frame period reaches a previously determined time, and repeatedly selects the same FRC pattern during one or more frame periods or selects a FRC pattern after next. The FRC method adds a FRC compensation value to subpixels defined by the selected FRC pattern in pixels of a pixel array, of which a polarity is inverted based on a previously determined inversion method, and transfers the addition value to a data driving circuit.

Figure 1:
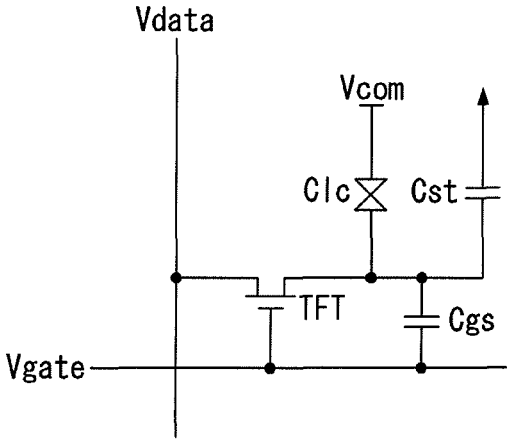
FIG. 1 (RELATED ART)
FIG. 1 is an equivalent circuit diagram schematically showing a pixel of a liquid crystal display panel.
Figure 2:
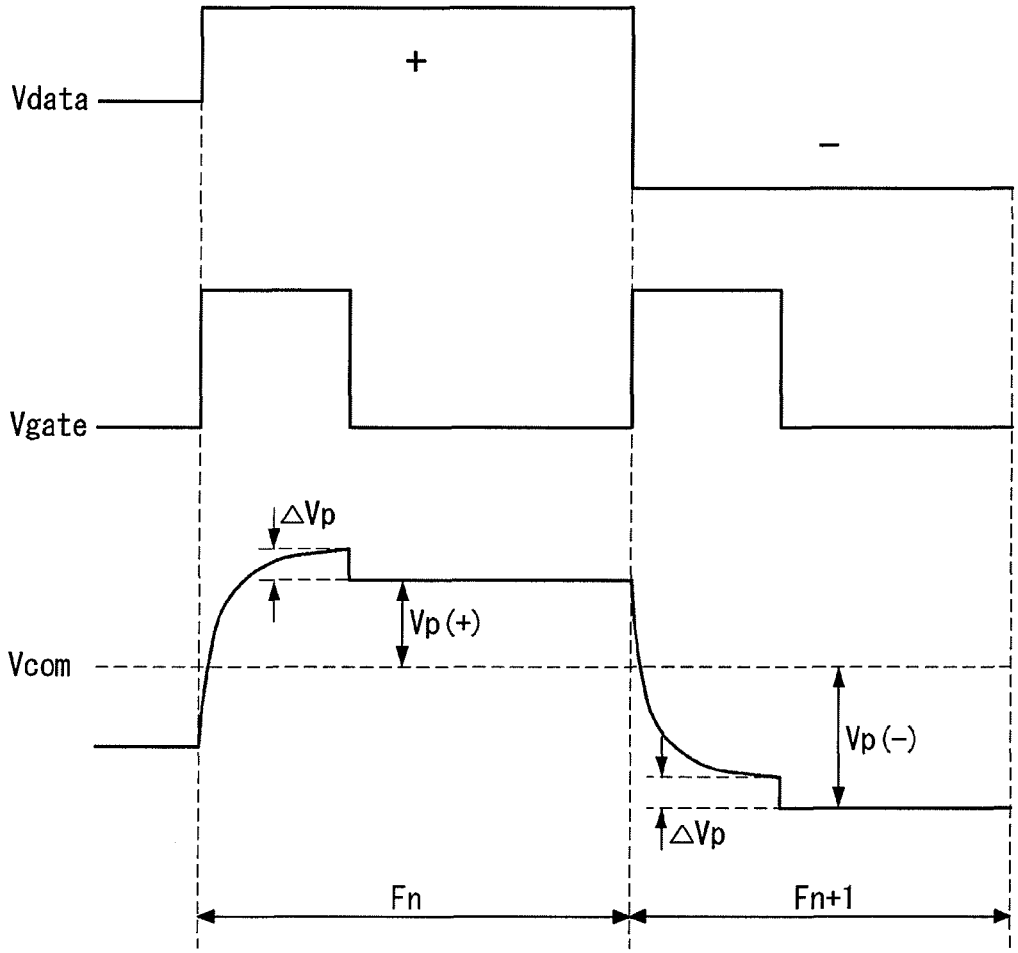
FIG. 2 (RELATED ART)
FIG. 2 is a waveform diagram showing signals and a liquid crystal cell voltage applied to a subpixel shown in FIG. 1.
Figure 3:
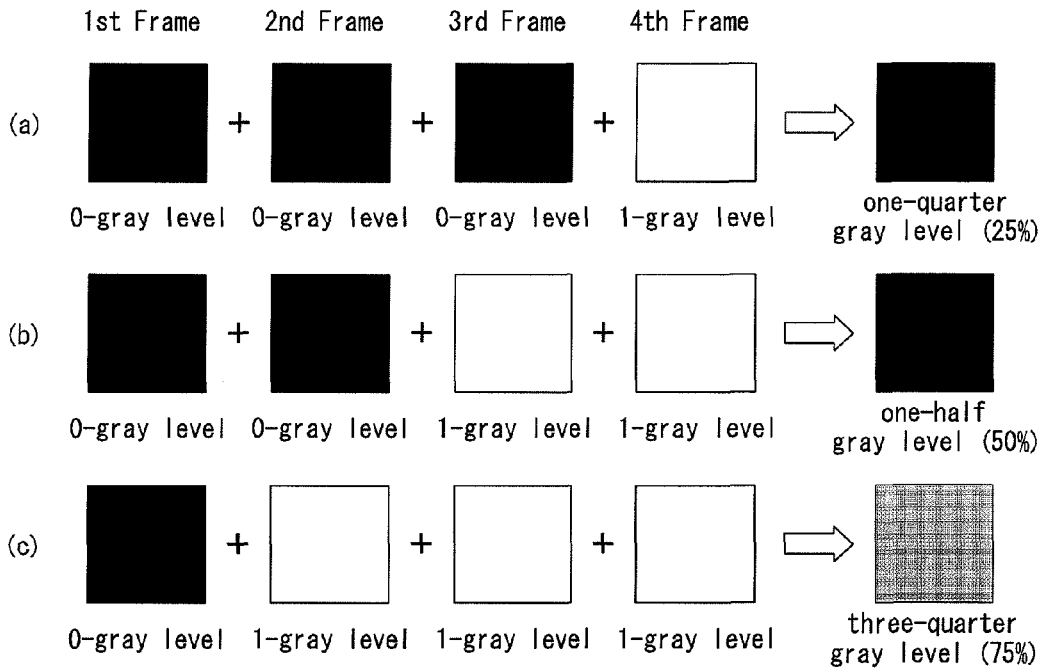
FIG. 3 (RELATED ART)
FIGS. 3 and 4 illustrate an operation principle of frame rate control (FRC)
Figure 4:
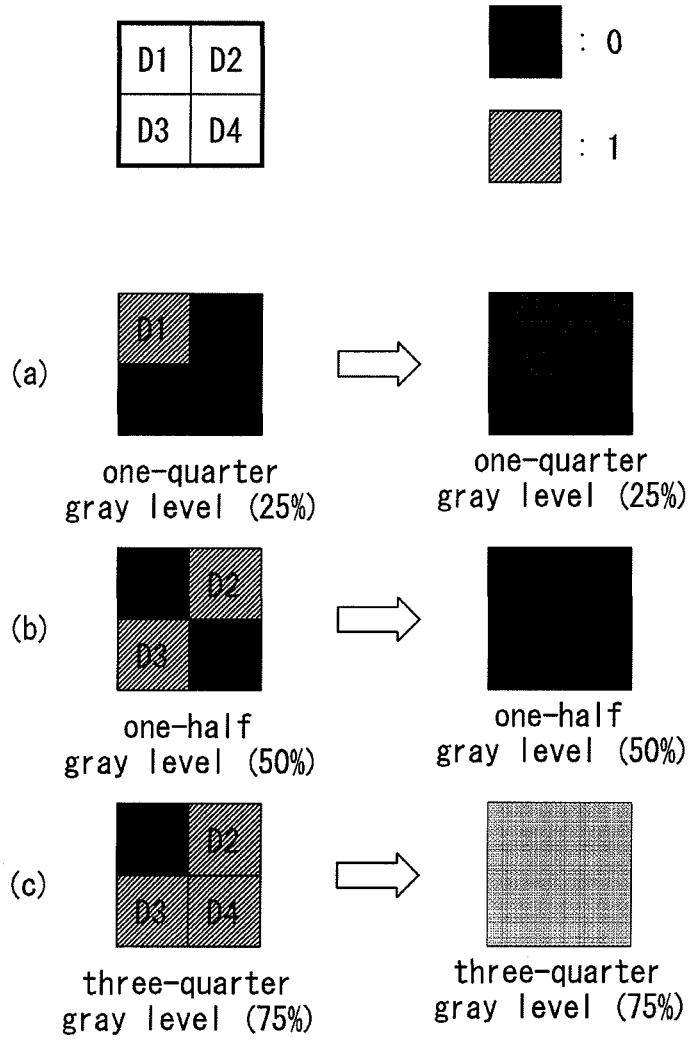
FIG. 4 (RELATED ART)
Figure 5:
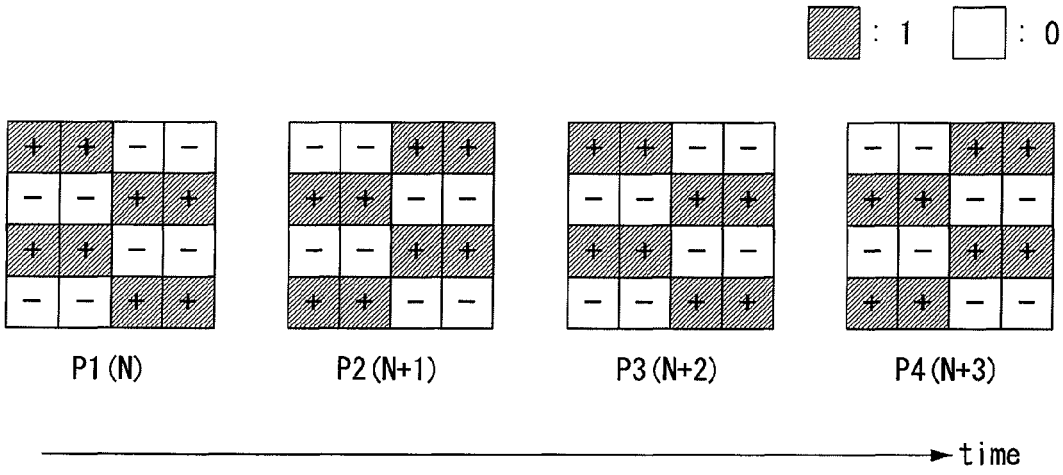
FIG. 5 (RELATED ART)
FIG. 5 illustrates an example of subpixels, driven at the same polarity, to which a FRC compensation value is written, when FRC is applied to a dot inversion method.
Figure 6:
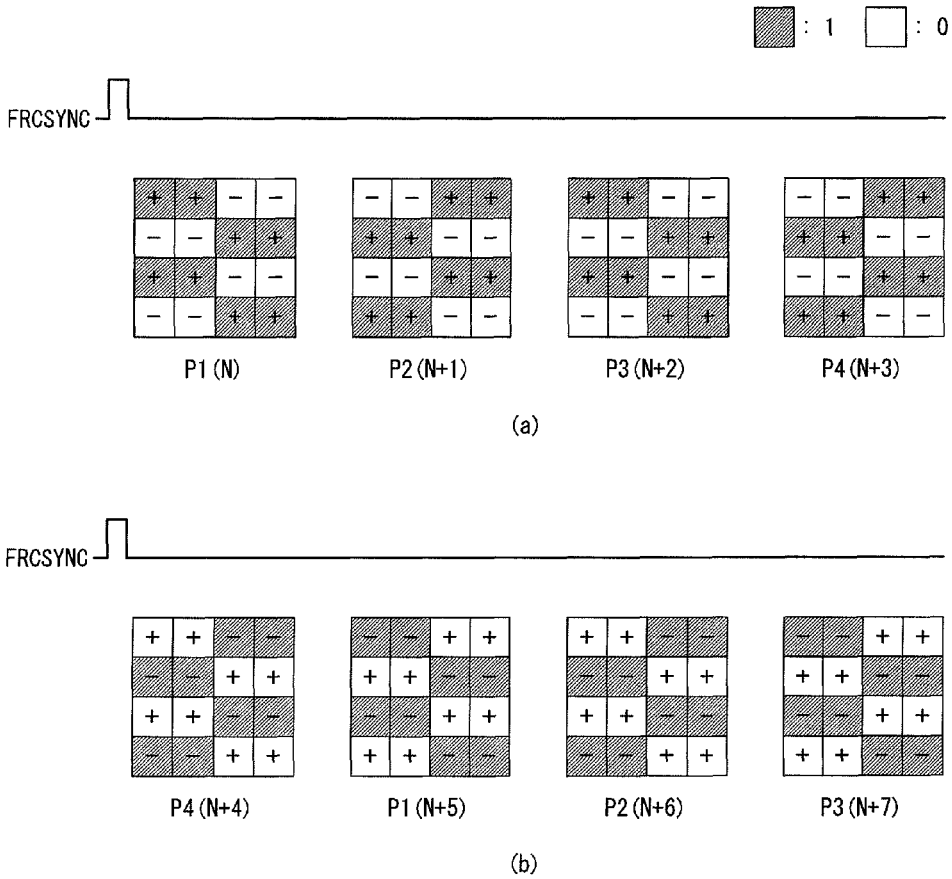
FIG. 6 illustrates an example of an FRC method according to an example embodiment of the invention.
Figure 7:
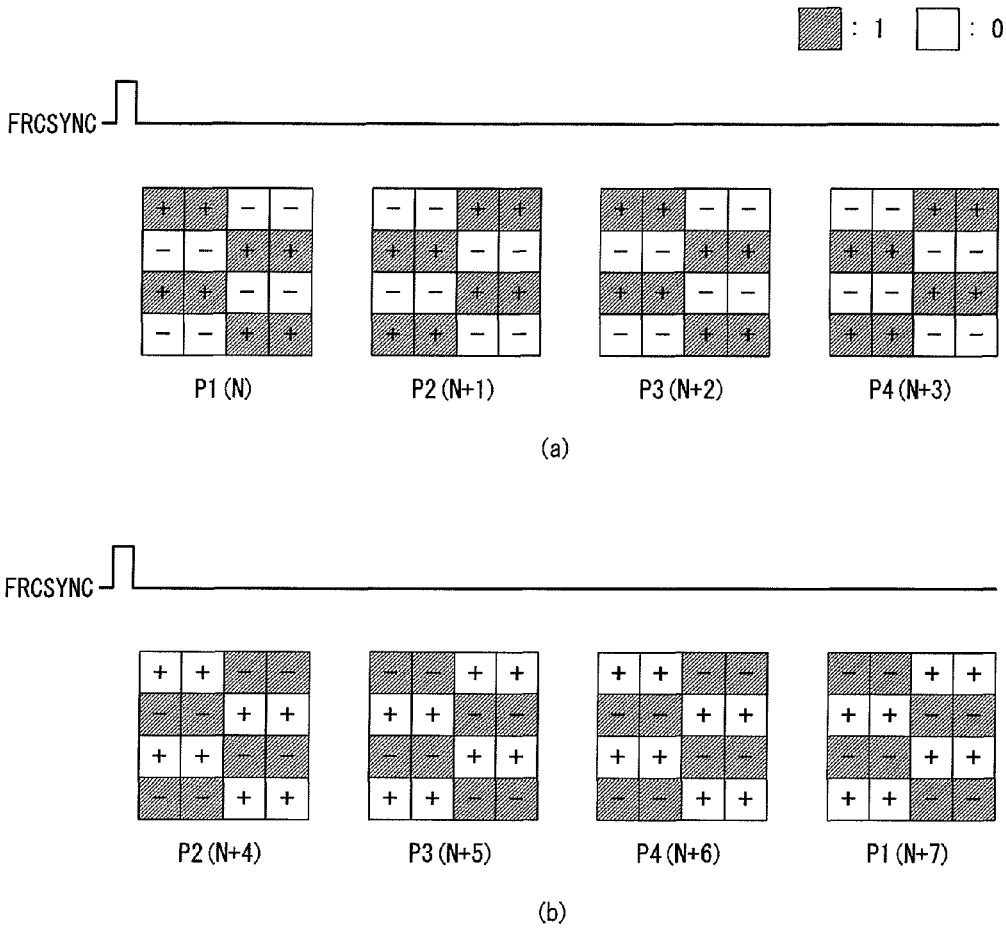
FIG. 7 illustrates another example of an FRC method according to an example embodiment of the invention.

As shown in FIGS. 6 and 7, a pixel array of a liquid crystal display according to an example embodiment of the invention is charged to a data voltage, of which a polarity is inverted based on a dot inversion method.

In the dot inversion method, polarities of subpixels of the pixel array are inverted every N dots in the terms of space and are inverted every N frame periods in the terms of time, where N is a positive integer. As shown in FIGS. 6 and 7, a vertical 1-dot inversion method and a horizontal 2-dot inversion method may be selected as the dot inversion method. However, the dot inversion method is not limited thereto. For example, the dot inversion method may be one of a vertical 1-dot inversion method, a horizontal 1-dot inversion method, a vertical 2-dot inversion method, and a horizontal 2-dot inversion method. In the vertical 1-dot and horizontal 2-dot inversion methods, polarities of subpixels arranged along a line direction (or a horizontal direction) are inverted every two dots, and polarities of subpixels arranged along a column direction (or a vertical direction) are inverted every one dot. In the vertical 1-dot and horizontal 2-dot inversion methods, polarities of subpixels may be inverted every one frame period.

The FRC method according to the embodiment of the invention adds a FRC compensation value '1' to video data, which will be written to subpixels defined by a plurality of FRC patterns P1 to P4 defining positions of the subpixels, to which the FRC compensation value will be written. The FRC patterns P1 to P4 define subpixels, to which the FRC compensation value is written, and differently define positions of the subpixels. The FRC patterns P1 to P4 are not limited to patterns shown in FIGS. 6 and 7. In each of the FRC patterns P1 to P4, the number and the positions of subpixels, to which the FRC compensation value is written, may vary depending on a FRC compensation gray value. In FIGS. 6 and 7, the number of circulated FRC patterns is 4, but the embodiment of the invention is not limited thereto.

The FRC method according to the embodiment of the invention counts frame periods and selects the FRC patterns P1 to P4 based on a frame count value. More specifically, the FRC method according to the embodiment of the invention selects the first FRC pattern P1 in an N-th frame period and then selects the second FRC pattern P2 in an (n+1)-th frame period. Subsequently, the FRC method according to the embodiment of the invention selects the third FRC pattern P3 in an (N+2)-th frame period and then selects the fourth FRC pattern P4 in an (N+3)-th frame period. In other words, the FRC method according to the embodiment of the invention sequentially selects the first to fourth FRC patterns P1 to P4 in the order named each time the frame count value increases, thereby writing the FRC compensation value to the subpixels of the pixel array.

Subsequently, the FRC method according to the embodiment of the invention holds or skips the frame count value when reaching a previously determined time. As a result, as shown in FIG. 6, when the frame period reaches the previously determined time, the FRC method according to the embodiment of the invention holds the FRC pattern without changing the FRC pattern. Alternatively, as shown in FIG. 7, when the frame period reaches the previously determined time, the FRC method according to the embodiment of the invention selects not a next FRC pattern but a FRC pattern after next. Accordingly, the FRC method according to the embodiment of the invention may prevent or reduce the subpixels, to which the FRC compensation value is written, from being dominant to one polarity.

As shown in (a) of FIG. 6, the FRC method according to the embodiment of the invention sequentially selects the first to fourth FRC patterns P1 to P4 in the order named during the N-th to (N+3)-th frame periods. Hence, the first to fourth FRC patterns P1 to P4 are circulated and selected for a predetermined period of time. In (a) of FIG. 6, the subpixels, to which the FRC compensation value is written, are subpixels driven at a positive data voltage. Subsequently, as shown in (b) of FIG. 6, when the frame period reaches the previously determined time, for example, an (N+4)-th frame period, the FRC method according to the embodiment of the invention holds the FRC pattern in a previous state (i.e., the fourth FRC pattern P4 in the (N+3)-th frame period), and then sequentially selects the first to fourth FRC patterns P1 to P4 in the order named. In (b) of FIG. 6, the subpixels, to which the FRC compensation value is written, are subpixels driven at a negative data voltage. The polarities of the subpixels are inverted in each frame period. Because of this, even when the same fourth FRC pattern P4 are applied in the (N+3)-th frame period and the (N+4)-th frame period, the subpixels, to which the FRC compensation value is written in the (N+3)-th frame period, are charged to the positive data voltage. On the other hand, the subpixels, to which the FRC compensation value is written in the (N+4)-th frame period, are charged to the negative data voltage. As a result, the subpixels, to which the FRC compensation value is written during the N-th to (N+3)-th frame periods, are subpixels charged to the positive data voltage, and the subpixels, to which the FRC compensation value is written during the (N+4)-th to (N+7)th frame periods, are subpixels charged to the negative data voltage. Thus, because the polarities of the subpixels change to other polarity after a predetermined period of time passed, the polarities of the subpixels are balanced.

As shown in (a) of FIG. 7, the FRC method according to the embodiment of the invention sequentially selects the first to fourth FRC patterns P1 to P4 in the order named during the N-th to (N+3)-th frame periods. Hence, the first to fourth FRC patterns P1 to P4 are circulated and selected for a predetermined period of time. In (a) of FIG. 7, the subpixels, to which the FRC compensation value is written, are subpixels driven at the positive data voltage. Subsequently, as shown in (b) of FIG. 7, when the frame period reaches the previously determined time, for example, the (N+4)-th frame period, the FRC method according to the embodiment of the invention changes from the fourth FRC pattern P4 to the second FRC pattern P2, and then sequentially selects the third FRC pattern P3, the fourth FRC pattern P4, and the first FRC pattern P1 in the order named. In (b) of FIG. 7, the subpixels, to which the FRC compensation value is written, are subpixels driven at the negative data voltage. The polarities of the subpixels are inverted in each frame period. Because of this, even when the fourth FRC pattern P4 and the second FRC pattern P2, which is substantially the same as the fourth FRC pattern P4, are applied in the (N+3)-th frame period and the (N+4)-th frame period, the subpixels, to which the FRC compensation value is written in the (N+3)-th frame period, are charged to the positive data voltage. On the other hand, the subpixels, to which the FRC compensation value is written in the (N+4)-th frame period, are charged to the negative data voltage. As a result, the subpixels, to which the FRC compensation value is written during the N-th to (N+3)-th frame periods, are subpixels charged to the positive data voltage, and the subpixels, to which the FRC compensation value is written during the (N+4)-th to (N+7)th frame periods, are subpixels charged to the negative data voltage. Thus, because the polarities of the subpixels change to other polarity after a predetermined period of time passed, the polarities of the subpixels are balanced.

The FRC method according to the embodiment of the invention counts frame periods, selects a next FRC pattern each time the frame count value increases, and holds or skips the frame count value so as to invert the polarities of the subpixels, to which the FRC compensation value is written, after a predetermined period of time passed. For this, the FRC method according to the embodiment of the invention uses a FRC hold or skip sync signal FRCSYNC, so as to control a hold timing or a skip timing of the frame count value. As shown in FIGS. 6 to 11, pulses of the FRC hold/skip sync signal FRCSYNC are generated at a time when the frame count value is held or skipped.

Figure 8:
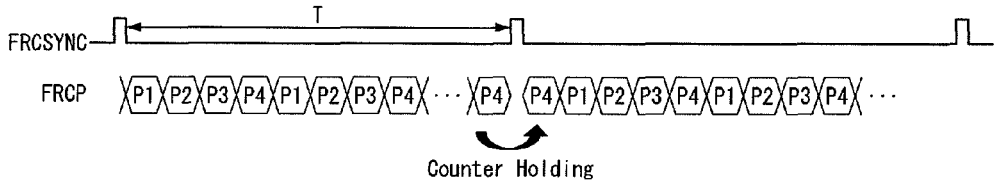
FIG. 8 is a waveform diagram showing FRC hold/skip sync signals and FRC patterns applied to the FRC method illustrated in FIG. 6.
Figure 9:
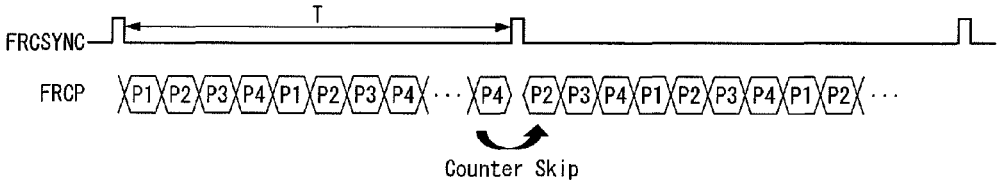
FIG. 9 is a waveform diagram showing FRC hold/skip sync signals and FRC patterns applied to the FRC method illustrated in FIG. 7.

The FRC hold/skip sync signal FRCSYNC applied to the FRC method illustrated in FIG. 6 is shown in FIG. 8, and the FRC hold/skip sync signal FRCSYNC applied to the FRC method illustrated in FIG. 7 is shown in FIG. 9. A pulse period T of the FRC hold/skip sync signal FRCSYNC may be set to several tens of frame periods. The pulse period T of the FRC hold/skip sync signal FRCSYNC may be fixed at a predetermined time or may change as shown in FIGS. 10 and 11.

Figure 10:
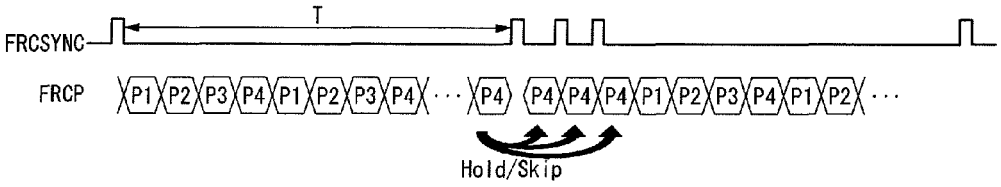
FIG. 10 is a waveform diagram showing an example of holding or skipping an FRC pattern during a plurality of frame periods.

FIG. 10 is a waveform diagram showing an example of holding or skipping the FRC pattern during a plurality of frame periods.

As shown in FIG. 10, the FRC method according to the embodiment of the invention sequentially selects the FRC patterns based on a predetermined circular rule, and then fixes the FRC pattern without changing the FRC pattern during a plurality of successive frame periods, which follow a previously determined time, when reaching the previously determined time.

Figure 11:
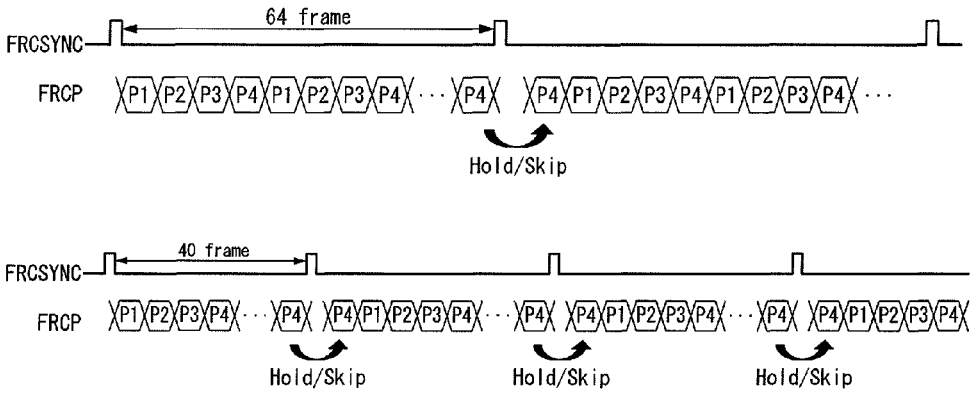
FIG. 11 is a waveform diagram showing an example where a pulse period of an FRC hold/skip sync signal changes.

FIG. 11 is a waveform diagram showing an example where the pulse period T of the FRC hold/skip sync signal FRCSYNC changes.

As shown in FIG. 11, the FRC method according to the embodiment of the invention changes the pulse period T of the FRC hold/skip sync signal FRCSYNC, thereby adjusting a hold timing and a skip timing of the FRC pattern. For example, the FRC method according to the embodiment of the invention may set a cycle of the hold timing and a cycle of the skip timing of the FRC pattern to 64 frame periods or 40 frame periods. Alternatively, the FRC method according to the embodiment of the invention may set the cycle of the hold timing and the cycle of the skip timing of the FRC pattern to 64 frame periods for a predetermined period of time and then may reduce them to 40 frame periods.

Figure 12:
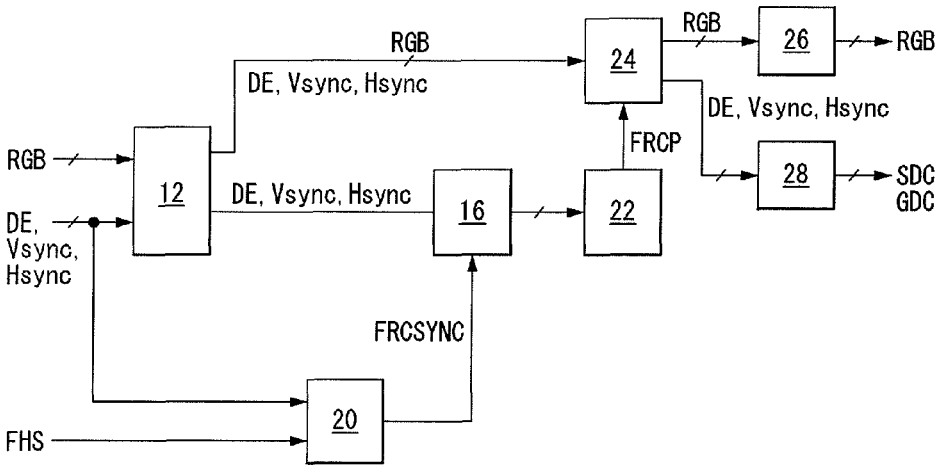
FIG. 12 is a block diagram showing configuration of a FRC device according to an example embodiment of the invention.

FIG. 12 is a block diagram of a FRC device according to the embodiment of the invention.

As shown in FIG. 12, the FRC device according to the embodiment of the invention includes a data synchronization unit 12, a frame counter 16, an FRC hold/skip controller 20, an FRC pattern selection unit 22, and an FRC compensation unit 24.

The data synchronization unit 12 receives digital video data RGB of an input image and external timing signals. The external timing signals include a vertical sync signal Vsync, a horizontal sync signal Hsync, a data enable DE, a main clock CLK, etc. The data synchronization unit 12 samples the digital video data RGB of the input image to a timing of the main clock CLK and synchronizes the digital video data RGB and the external timing signal.

The frame counter 16 counts frame periods using one of the vertical sync signal Vsync, the horizontal sync signal Hsync, and the data enable DE. For example, the frame counter 16 increases a frame count value by one every one period of the vertical sync signal Vsync so as to accumulate the frame count value each time one frame period passed, thereby counting the frame periods. Further, the frame counter 16 counts the horizontal sync signal Hsync and the data enable DE. When a count value is accumulated as many as the number of lines of a display panel, the frame counter 16 increases the frame count value by one, thereby counting the frame periods. The frame counter 16 holds or skips the frame count value in response to the FRC hold/skip sync signal FRCSYNC received from the FRC hold/skip controller 20. For example, when a current frame count value is '5', the frame counter 16 fixes the frame count value to '5' or changes the frame count value to '7' even if the frame period passed due to the input of the pulse of the FRC hold/skip sync signal FRCSYNC.

The FRC hold/skip controller 20 receives frame hold/skip data FHS. The frame hold/skip data FHS is digital data including frame hold/skip cycle information. Manufacturers, makers, or users of the liquid crystal display may input the frame hold/skip data FHS to the FRC hold/skip controller 20 and may control the pulse period T of the FRC hold/skip sync signal FRCSYNC. The FRC hold/skip controller 20 generates the FRC hold/skip sync signal FRCSYNC illustrated in FIGS. 6 to 11 in response to the frame hold/skip data FHS.

The FRC pattern selection unit 22 selects the FRC patterns P1 to P4 based on the frame count value received from the frame counter 16 through the methods illustrated in FIGS. 6 to 11. For example, if the four FRC patterns P1 to P4 are set, the FRC pattern selection unit 22 divides the frame count value by 4. Hence, when a remainder is '1', the FRC pattern selection unit 22 selects the first FRC pattern P1. When a remainder is '2', the FRC pattern selection unit 22 selects the second FRC pattern P2. When a remainder is '3', the FRC pattern selection unit 22 selects the third FRC pattern P3. When a remainder is '0', the FRC pattern selection unit 22 selects the fourth FRC pattern P4. The FRC pattern selection unit 22 supplies FRC pattern data including position information of the pixels, to which the FRC compensation value will be written in the selected FRC pattern, to the FRC compensation unit 24.

The FRC compensation unit 24 removes least significant bit (LSB) from I-bit digital video data and converts the I-bit digital video data into J-bit digital video data, where I is a positive integer equal to or greater than 6 and J is a positive integer less than 'I'. The FRC compensation unit 24 adds the FRC compensation value to digital video data, which will be written to the subpixels defined by the FRC pattern, selected among the J-bit digital video data in response to the FRC pattern data received from the FRC pattern selection unit 22.

The image sticking may hardly appear in the related art FRC method depending on the input image. Considering this, the FRC device according to the embodiment of the invention may further include another frame counter and a multiplexer, so as to selectively apply the hold and skip functions of the frame counter.

Figure 13:
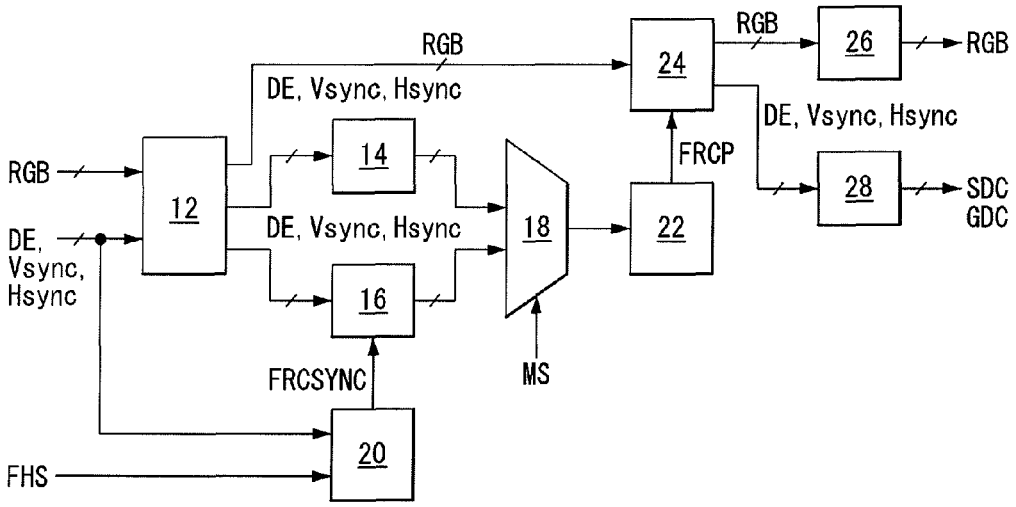
FIG. 13 is a block diagram showing another configuration of a FRC device according to an example embodiment of the invention.

As shown in FIG. 13, the FRC device according to the embodiment of the invention further includes a first frame counter 14, a second frame counter 16, and a multiplexer 18.

The first frame counter 14 counts one of the vertical sync signal Vsync, the horizontal sync signal Hsync, and the data enable DE and accumulates a frame count value by one each time a frame period changes. The FRC hold/skip sync signal FRCSYNC is not input to the first frame counter 14. Thus, the first frame counter 14 normally accumulates the frame count value irrespective of the pulse period T of the FRC hold/skip sync signal FRCSYNC.

The second frame counter 16 substantially has the same configuration as the frame counter shown in FIG. 12. Thus, the second frame counter 16 accumulates the frame count value each time a frame period changes, and also holds or skips the frame count value in response to the FRC hold/skip sync signal FRCSYNC.

The multiplexer 18 selects one of an output of the first frame counter 14 and an output of the second frame counter 16 in response to a mode selection signal MS received from the outside and transfers the selected output to a FRC pattern selection unit 22. The mode selection signal MS may be input by manufacturers, makers, or users of the liquid crystal display or may be fixed to a specific logic value. Further, the logic value of the mode selection signal MS may adaptively change based on the result of an analysis of the input image.

Configurations of a data synchronization unit 12, an FRC hold/skip controller 20, the FRC pattern selection unit 22, and an FRC compensation unit 24 shown in FIG. 13 are substantially the same as those shown in FIG. 12.

Figure 14:
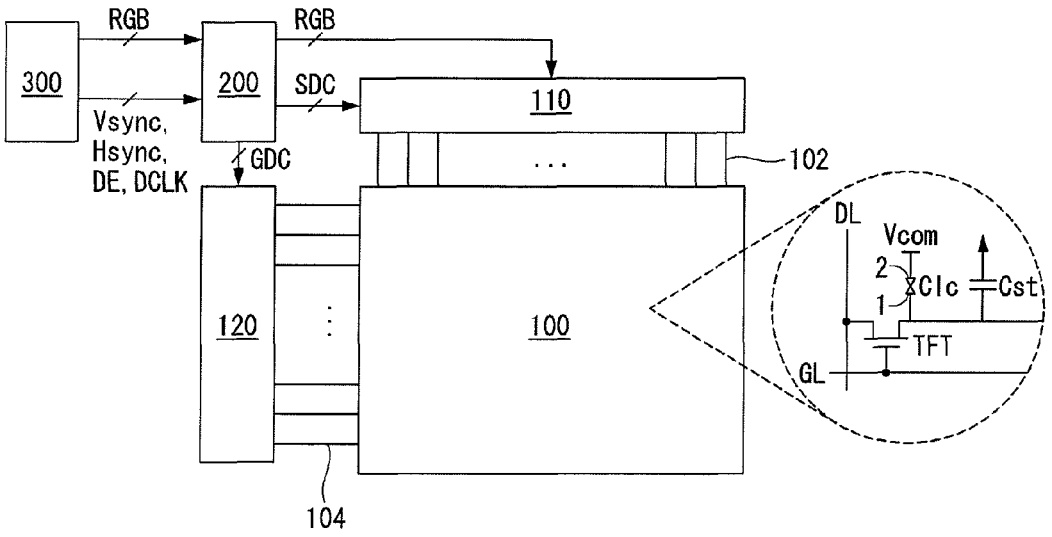
FIG. 14 is a block diagram of a liquid crystal display according to an example embodiment of the invention.

The FRC device shown in FIGS. 12 and 13 may be embedded in a timing controller shown in FIG. 14. In this instance, the FRC device is connected to a data interface transmitter 26 and a timing control signal generator 28. The data interface transmitter 26 supplies the digital video data RGB output from the FRC compensation unit 24 to a data driving circuit 110 (refer to FIG. 14) of the liquid crystal display through a standard interface such as mini low voltage differential signaling (LVDS) interface. The data interface transmitter 26 may transfer the digital video data RGB based on interface protocol disclosed in Korean Patent Application No. 10-2008-0127458 (Dec. 15, 2008), U.S. patent application Ser. No. 12/543,996 (Aug. 19, 2009), Korean Patent Application No. 10-2008-0127456 (Dec. 15, 2008), U.S. patent application Ser. No. 12/461,652 (Aug. 19, 2009), Korean Patent Application No. 10-2008-0132466 (Dec. 23, 2008), and U.S. patent application Ser. No. 12/537,341 (Aug. 7, 2009) corresponding to the present applicant, and which are hereby incorporated by reference in their entirety.

The timing control signal generator 28 counts timing signals such as the vertical sync signal Vsync, the horizontal sync signal Hsync, the data enable DE, and the main clock CLK and generates timing control signals SDC and GDC for controlling operation timings of the data driving circuit 110 and a gate driving circuit 120 (refer to FIG. 14) of the liquid crystal display.

FIG. 14 is a block diagram of a liquid crystal display according to the embodiment of the invention.

As shown in FIG. 14, the liquid crystal display according to the embodiment of the invention includes a liquid crystal display panel 100, a timing controller 200, the data driving circuit 110, the gate driving circuit 120, etc.

The liquid crystal display panel 100 includes a liquid crystal layer between two glass substrates. The liquid crystal display panel 100 includes a pixel array which is arranged in a matrix form defined by a crossings structure of data lines 102 and gate lines 104. The pixel array is charged to the data voltage, of which a polarity is inverted, based on a previously determined dot inversion method as shown in FIGS. 6 and 7.

The data lines 102, the gate lines 104 crossing the data lines 102, thin film transistors (TFTs) formed at crossings of the data lines 102 and the gate lines 104, pixel electrodes 1 of liquid crystal cells Clc connected to the TFTs, storage capacitors connected to the pixel electrodes 1, etc. are formed on a TFT array substrate of the liquid crystal display panel 100. Black matrixes, color filters, etc. are formed on a color filter array substrate of the liquid crystal display panel 100.

Each of the liquid crystal cells Clc is charged to the video data voltage supplied through the TFT and is driven by an electric field between the pixel electrode 1 and a common electrode 2. A common voltage Vcom is supplied to the common electrode 2. Polarizing plates are respectively attached to the TFT array substrate and the color filter array substrate of the liquid crystal display panel 100. Alignment layers for setting a pre-tilt angle of liquid crystal molecules are respectively formed on the surfaces contacting the liquid crystal layer in the TFT array substrate and the color filter array substrate of the liquid crystal display panel 100.

The liquid crystal display panel 100 may be implemented in a vertical electric field driving manner such as a twisted nematic (TN) mode and a vertical alignment (VA) mode, or may be implemented in a horizontal electric field driving manner such as an in-plane switching (IPS) mode and a fringe field switching (FFS) mode. The liquid crystal display according to the embodiment of the invention may be implemented as any type liquid crystal display including a transmissive liquid crystal display, a transflective liquid crystal display, and a reflective liquid crystal display. The transmissive liquid crystal display and the transflective liquid crystal display require a backlight unit which is omitted in the drawings. The backlight unit may be implemented as a direct type backlight unit or an edge type backlight unit.

The FRC device shown in FIGS. 12 and 13 may be embedded in the timing controller 200. The timing controller 200 converts I-bit digital video data RGB received from a host system 300 into J-bit digital video data and adds the FRC compensation value to the J-bit digital video data. The timing controller 200 then supplies it to the data driving circuit 110. The timing controller 200 receives timing signals, such as a vertical sync signal Vsync, a horizontal sync signal Hsync, a data enable DE, and a dot clock DCLK, from the host system 300. The timing controller 200 generates timing control signals for controlling an operation timing of the data driving circuit 110 and an operation timing of the gate driving circuit 120 using the timing signals. The timing control signals include a gate timing control signal GDC for controlling the operation timing of the gate driving circuit 120 and a data timing control signal SDC for controlling the operation timing of the data driving circuit 110 and the polarity of the data voltage.

The gate timing control signal GDC includes a gate start pulse GSP, a gate shift clock GSC, a gate output enable GOE, and the like. The gate start pulse GSP controls an operation start timing of the gate driving circuit 120. The gate shift clock GSC is a clock for shifting the gate start pulse GSP. The gate output enable GOE controls an output timing of the gate driving circuit 120.

The data timing control signal SDC includes a source start pulse SSP, a source sampling clock SSC, a polarity control signal POL, a source output enable SOE, and the like. The source start pulse SSP controls a data sampling start timing of the data driving circuit 110. The source sampling clock SSC is a clock which controls a sampling timing of the digital video data inside the data driving circuit 110. The source output enable SOE controls an output timing and a charge sharing timing of the data driving circuit 110. The polarity control signal POL controls a polarity inversion timing of the data voltage output from the data driving circuit 110.

The data driving circuit 110 latches the J-bit digital video data received from the timing controller 200 in response to the data timing control signal SDC. The data driving circuit 110 converts the digital video data RGB into positive and negative analog gamma compensation voltages and produces positive and negative analog data voltages. The data driving circuit 110 selects a polarity of the data voltage output to the data lines 102 in response to the polarity control signal POL. The timing controller 200 may control the polarity inversion of the pixel array using the polarity control signal POL.

The gate driving circuit 120 sequentially supplies the gate pulse synchronized with the data voltage to the gate lines 104 in response to the gate timing control signal GDC.

The host system 300 may be one of a TV system, a home theater system, a personal computer (PC), a set-top box for broadcasting reception, a navigation system, a DVD player, a Blu-ray player, and a phone system. The host system 300 generates the digital video data RGB and the timing signals Vsync, Hsync, DE, and DCLK and supplies them to the timing controller 200.

As described above, when the frame period reaches the previously determined frame period, the embodiment of the invention repeatedly selects the same FRC pattern during one or more frame periods or selects the FRC pattern after next, thereby performing the FRC compensation. Hence, the embodiment of the invention may periodically prevent or reduce the subpixels of the pixel array from being dominant to one polarity when the FRC method is applied to the liquid crystal display. As a result, the embodiment of the invention may prevent the DC drive of the pixels and thus may prevent the image sticking resulting from the FRC method.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a frame rate control (FRC) device configured to add an FRC compensation value to digital video data using a plurality of FRC patterns defining subpixels, to which the FRC compensation value will be written;

a data driving circuit configured to convert the digital video data received from the FRC device into a data voltage and invert a polarity of the data voltage based on a previously determined inversion method; and a liquid crystal display panel including a pixel array charged to the data voltage received from the data driving circuit, wherein the FRC device counts frame periods and increases a frame count value each time the frame period changes, and wherein the FRC device changes to a next FRC pattern in previously determined order in response to the frame count value and holds or skips the frame count value when the frame period reaches a previously determined time.

2. The liquid crystal display of claim 1, wherein when the frame period reaches the previously determined time, the FRC device repeatedly selects the same FRC pattern.

3. The liquid crystal display of claim 1, wherein when the frame period reaches the previously determined time, the FRC device selects a FRC pattern after next.

4. The liquid crystal display of claim 1, wherein the FRC device removes least significant bit (LSB) from I-bit digital video data and converts the I-bit digital video data into J-bit digital video data, where I is a positive integer equal to or greater than 6 and J is a positive integer less than 'I', wherein the FRC device adds the FRC compensation value to the digital video data, which will be written to subpixels defined by the selected FRC pattern, selected among the J-bit digital video data.

5. The liquid crystal display of claim 4, wherein the FRC device includes:

a frame counter configured to accumulate the frame count value by one each time one frame period passed;

an FRC hold/skip controller configured to receive frame hold/skip data indicating one of a hold timing and a skip timing of the frame counter and generate a FRC hold/skip sync signal;

an FRC pattern selection unit configured to select the FRC patterns based on the frame count value received from the frame counter; and an FRC compensation unit configured to add the FRC compensation value to the digital video data, which will be written to subpixels defined by the selected FRC pattern, selected among the J-bit digital video data, wherein the frame counter holds the frame count value or skips to a frame count value after next in response to the FRC hold/skip sync signal.

6. The liquid crystal display of claim 4, wherein the FRC device includes:

a first frame counter configured to accumulate the frame count value by one each time one frame period passed;

a second frame counter configured to accumulate the frame count value by one each time one frame period passed and hold the frame count value or skip to a frame count value after next in response to a FRC hold/skip sync signal;

a multiplexer configured to select one of a frame count value output from the first frame counter and a frame count value output from the second frame counter in response to a mode selection signal;

an FRC hold/skip controller configured to receive a frame hold/skip data indicating one of a hold timing and a skip timing of the second frame counter and generate the FRC hold/skip sync signal;

an FRC pattern selection unit configured to select the FRC patterns based on the frame count value selected by the multiplexer; and an FRC compensation unit configured to add the FRC compensation value to the digital video data, which will be written to subpixels defined by the selected FRC pattern, selected among the J-bit digital video data.

7. A frame rate control (FRC) method for a liquid crystal display, comprising:

selecting a plurality of FRC patterns, which define subpixels, to which a FRC compensation value will be written, as subpixels of different positions, and adding a predetermined FRC compensation value to digital video data based on the selected FRC pattern; and converting the digital video data, to which the FRC compensation value is added, into a data voltage and inverting a polarity of the data voltage based on a previously determined inversion method to supply the data voltage to a pixel array of a liquid crystal display panel;

wherein the adding of the predetermined FRC compensation value to the digital video data includes:

counting frame periods and increasing a frame count value each time the frame period changes; and changing to a next FRC pattern in previously determined order in response to the frame count value and holding or skipping the frame count value when the frame period reaches a previously determined time.

* * * * *